US007162947B2

(12) United States Patent
Kucher et al.

(10) Patent No.: US 7,162,947 B2
(45) Date of Patent: Jan. 16, 2007

(54) MOUNT FOR CYLINDER POSITION SENSOR

(75) Inventors: Trent S. Kucher, Peoria, IL (US); Thomas G. Skinner, Bolingbrook, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/742,531

(22) Filed: Dec. 19, 2003

(65) Prior Publication Data

US 2005/0132878 A1 Jun. 23, 2005

(51) Int. Cl.
*F01B 31/12* (2006.01)

(52) U.S. Cl. ..... 92/5 R; 92/168

(58) Field of Classification Search ..... 92/5 R, 92/168

See application file for complete search history.

(56) References Cited

U.S. PATENT DOCUMENTS

| | | | | |
|---|---|---|---|---|
| 3,750,537 | A | 8/1973 | Goade et al. | |
| 3,777,627 | A | 12/1973 | Goade | |
| 3,956,973 | A * | 5/1976 | Pomplas | 92/5 R |
| 4,982,652 | A | 1/1991 | Blatt | |
| 5,182,980 | A | 2/1993 | Greer | |
| 5,325,063 | A | 6/1994 | Morgan | |
| 5,455,509 | A | 10/1995 | Semura et al. | |
| 5,477,771 | A * | 12/1995 | Black | 92/5 R |
| 5,539,993 | A | 7/1996 | Kilpinen et al. | |
| 5,918,199 | A | 6/1999 | Yang et al. | |
| 6,147,342 | A | 11/2000 | Kucher | |
| 6,484,620 | B1 | 11/2002 | Arshad et al. | |
| 2003/0131724 | A1 | 7/2003 | Neumann | |

FOREIGN PATENT DOCUMENTS

| | | |
|---|---|---|
| DE | 100 49 505 A1 | 5/2001 |
| DE | 100 45 874 A1 | 3/2002 |

* cited by examiner

*Primary Examiner*—F. Daniel Lopez
(74) *Attorney, Agent, or Firm*—Finnegan, Henderson, Farabow, Garrett&Dunner; D. James Barnes

(57) ABSTRACT

A method and apparatus for determining the position of a rod member of a cylinder assembly are provided. The cylinder assembly may include a cylinder body, a gland member, a sensor mount, a rod member, and a position sensor attached to the sensor mount. The cylinder body may have a first mounting portion disposed thereon. The gland member may be disposed within a gland opening of the cylinder body. The sensor mount may have a second mounting portion disposed thereon and may be attached to the cylinder body via a coupling engagement between the second mounting portion of the sensor mount and the first mounting portion of the cylinder body. The rod member may be slidably arranged within rod openings of the sensor mount and the gland member and may extend into a longitudinal cylinder chamber of the cylinder body.

29 Claims, 4 Drawing Sheets

MOUNT FOR CYLINDER POSITION SENSOR

TECHNICAL FIELD

The present invention relates generally to a mount for a position sensor and, more particularly, to a cylinder assembly with a position sensor mounted thereto.

BACKGROUND

Expansible chamber hydraulic cylinders having moveable piston-and-rod assemblies therein are widely used on industrial, earthmoving, and material handling machines and vehicles. It may be advantageous for such a machine or vehicle to include an automatic control system for automatically controlling the extension or retraction of a piston-and-rod assembly within a hydraulic cylinder so that partially or totally automatic work operations may be performed. In one type of automatic control system, a position sensor may be used to determine the position of the piston-and-rod assembly within the cylinder. One challenge with using such a position sensor is creating a robust, accurate, and affordable mount and mounting method for coupling the position sensor with the hydraulic cylinder.

U.S. Pat. No. 5,455,509, issued to Semura et al., discloses a device for mounting a position-detecting sensor to a hydraulic cylinder. Semura discloses a piston rod with a magnetic scale formed on the outer surface thereof and a magnetic sensor mounted on a cylinder head proximate the magnetic scale for detecting the magnetic scale and determining the position of the piston rod. The sensor is mounted on a block, and the block is mounted directly to the head of the cylinder by a plurality of bolts.

Prior sensor-mounting devices and methods for cylinder position sensors may provide complicated assembly operations or may unduly stress components of a cylinder assembly. For example, when a position sensor mount is affixed directly to the head or gland of a cylinder, alignment of the sensor mount (and sensor) with a pattern or detectable feature on the rod may be affected by the alignment (or misalignment) of the head or gland with a detectable feature on the rod. Moreover, bolting or otherwise attaching a sensor mount directly to the head or gland of a cylinder may complicate the required corresponding design or structure of the head or gland, thereby increasing production costs of the gland. Further, when it is desired to retrofit an existing cylinder with a position sensor, attachment of a sensor mount directly to an existing gland, such as by tapping bolt holes in the gland, may not be feasible or possible, for example due to the existing configuration of the gland or the condition of the gland.

The present invention is directed at overcoming one or more problems or disadvantages associated with prior sensor-mounting devices and methods.

SUMMARY OF THE INVENTION

In one aspect of the invention, a cylinder assembly is provided. The cylinder assembly may include a cylinder body, a gland member, a sensor mount, a rod member, and a position sensor. The cylinder body may have a longitudinal cylinder chamber therein, a gland opening at an end of the cylinder body, and a first mounting portion disposed on the cylinder body. The gland member may have a rod opening therein and may be disposed within the gland opening of the cylinder body. The sensor mount may have a rod opening therein and may be disposed proximate the end of the cylinder body and adjacent the gland member and may have a second mounting portion disposed on the sensor mount. The rod member may be slidably arranged within the rod openings of the sensor mount and the gland member and may extend into the longitudinal cylinder chamber of the cylinder body. The position sensor may be attached to the sensor mount. The sensor mount may be attached to the cylinder body via a coupling engagement between the second mounting portion of the sensor mount and the first mounting portion of the cylinder body.

In another aspect of the invention, a cylinder assembly is provided. The cylinder assembly may include a cylinder body, a gland member, a sensor mount, a rod member, and a position sensor. The cylinder body may have a longitudinal cylinder chamber therein, a gland opening at an end of the cylinder body, and a first mounting portion disposed on the cylinder body. The gland member may have a rod opening therein and may be disposed within the gland opening of the cylinder body. The sensor mount may have a rod opening therein and may be disposed proximate the end of the cylinder body and adjacent the gland member and may have a second mounting portion disposed thereon. The rod member may be slidably arranged within the rod openings of the sensor mount and the gland member and may extend into the longitudinal cylinder chamber of the cylinder body. The rod member may have one or more detectable features disposed longitudinally along the length of the rod. The position sensor may be attached to the sensor mount and may be operable to detect the detectable features. The second mounting portion of the sensor mount may be urged toward the first mounting portion of the cylinder body to hold the sensor in a substantially predetermined orientation relative the path of the one or more detectable features.

In a further aspect of the invention, a method may be provided for determining the position of a rod slidably arranged within a longitudinal cylinder chamber of a cylinder body having a gland member disposed within one end of the cylinder body, the gland member having a rod opening therein for slidably receiving the rod. The method may include providing a first mounting portion on the cylinder body; providing a sensor mount having a rod opening therein, a second mounting portion thereon, and a position sensor attached thereto; providing one or more detectable features along the length of the rod; aligning the position sensor with a path of the one or more detectable features; mounting the sensor mount to the end of the cylinder body and adjacent the gland member by fastening together the second mounting portion of the sensor mount and the first mounting portion of the cylinder body; moving the rod within the rod openings of the gland member and the sensor mount; and operating the sensor to detect the detectable features of the rod and to generate a signal as a function of the detectable features, the signal being indicative of the position of the rod.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate exemplary embodiments or features of the invention and, together with the description, serve to explain the principles of the invention. In the drawings.

Although the drawings depict exemplary embodiments or features of the present invention, the drawings are not necessarily to scale, and certain features may be exaggerated in order to better illustrate and explain the present invention. The exemplifications set out herein illustrate exemplary embodiments or features of the invention and such exemplifications are not to be construed as limiting the scope of the invention in any manner.

DETAILED DESCRIPTION

Reference will now be made in detail to embodiments or features of the invention, examples of which are illustrated in the accompanying drawings. Wherever possible, the same or corresponding reference numbers will be used throughout the drawings to refer to the same or corresponding parts.

Figure 1A:
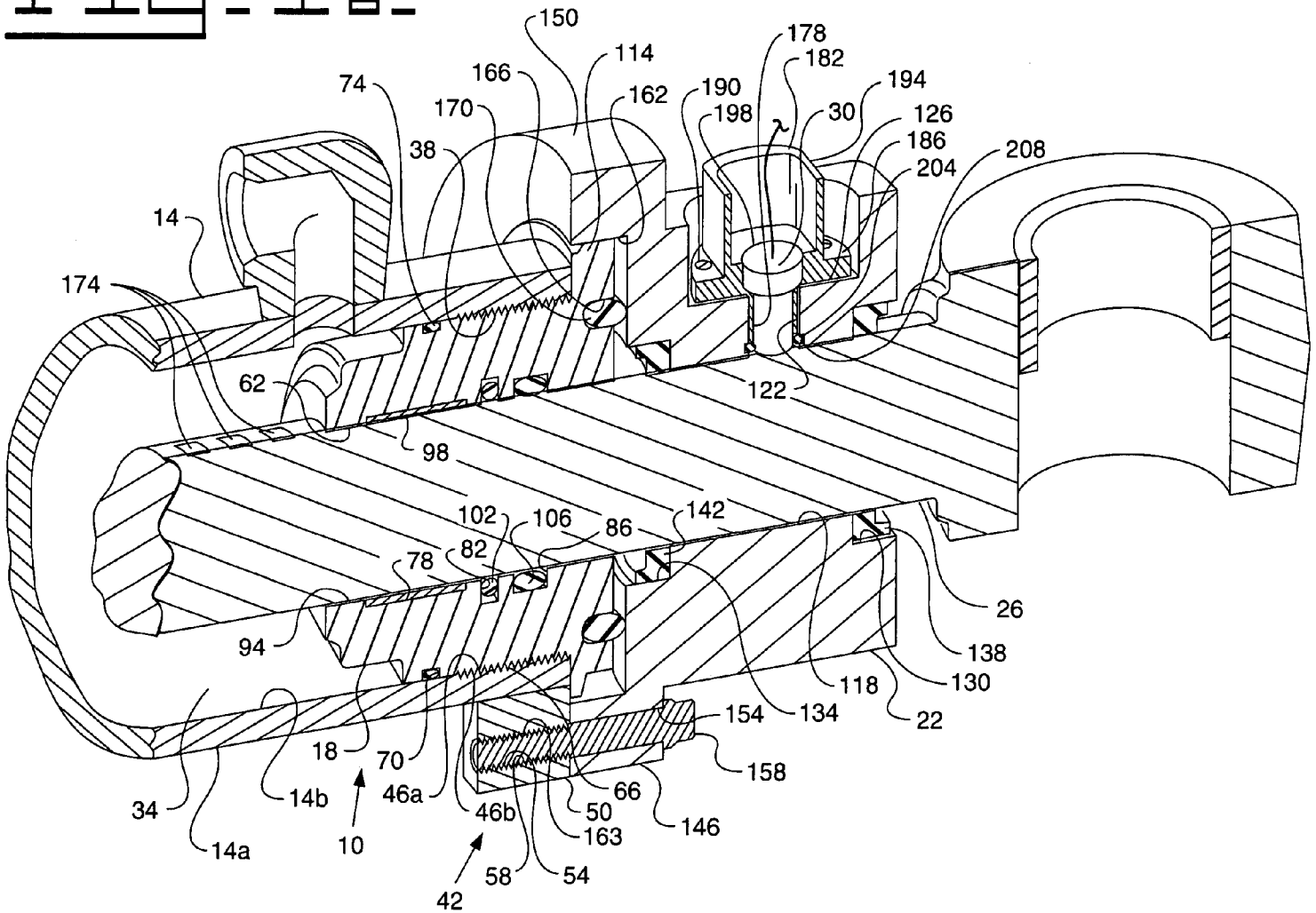
FIG. 1A is a fragmentary cutaway perspective view of an embodiment of a cylinder assembly constructed and operable according to the present invention.
Figure 2:
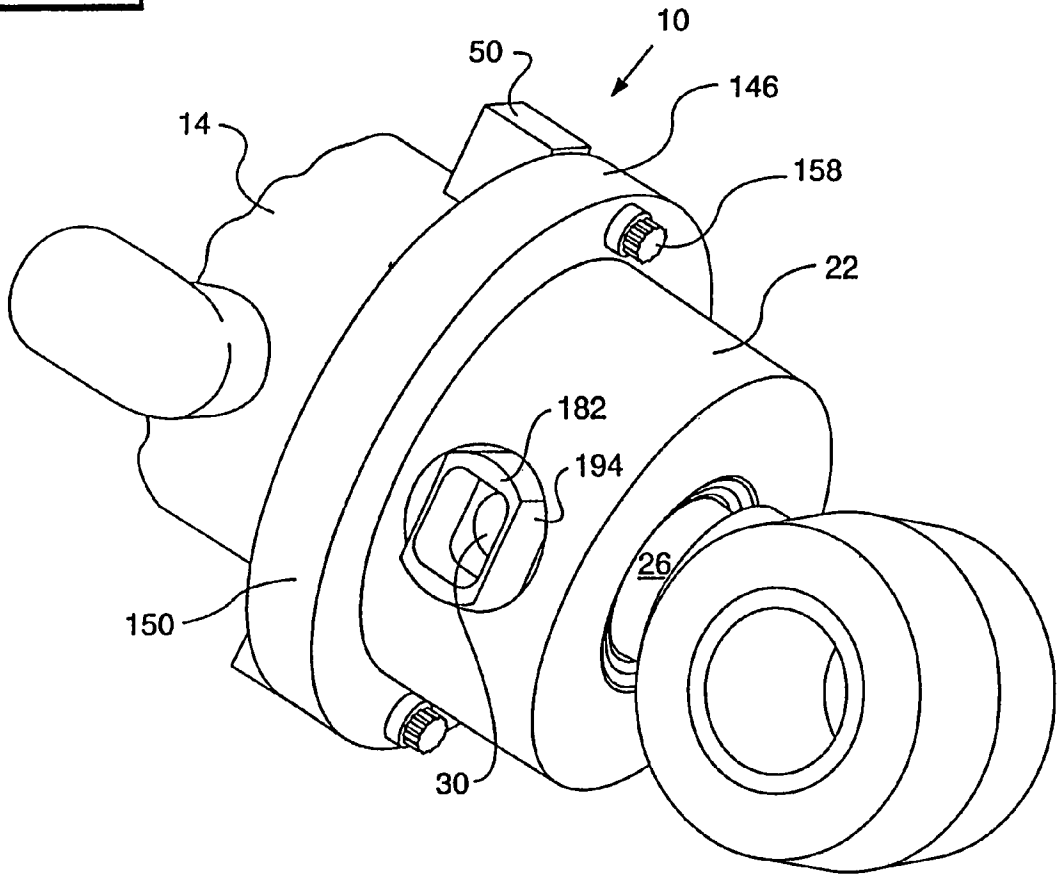
FIG. 2 is a fragmentary perspective view of the cylinder assembly shown in FIG. 1A.

Referring to FIGS. 1A and 2, an exemplary embodiment of the present invention includes a cylinder assembly 10 having a cylinder body 14, a gland member 18, a sensor mount 22, a rod member 26, and a position sensor 30.

The cylinder body 14 provides a longitudinal cylinder chamber 34 therein for receipt of the rod member 26. The cylinder body 14 includes a radially outer wall 14*a* and a radially inner wall 14*b*. A gland opening 38 is provided at one end 42 of the cylinder body 14 and is configured and arranged for receipt of the gland member 18. Threads 46*a* may be provided on the inner wall 14*b* within the gland opening 38 for engagement with threads 46*b* on the gland member 18.

Figure 3:
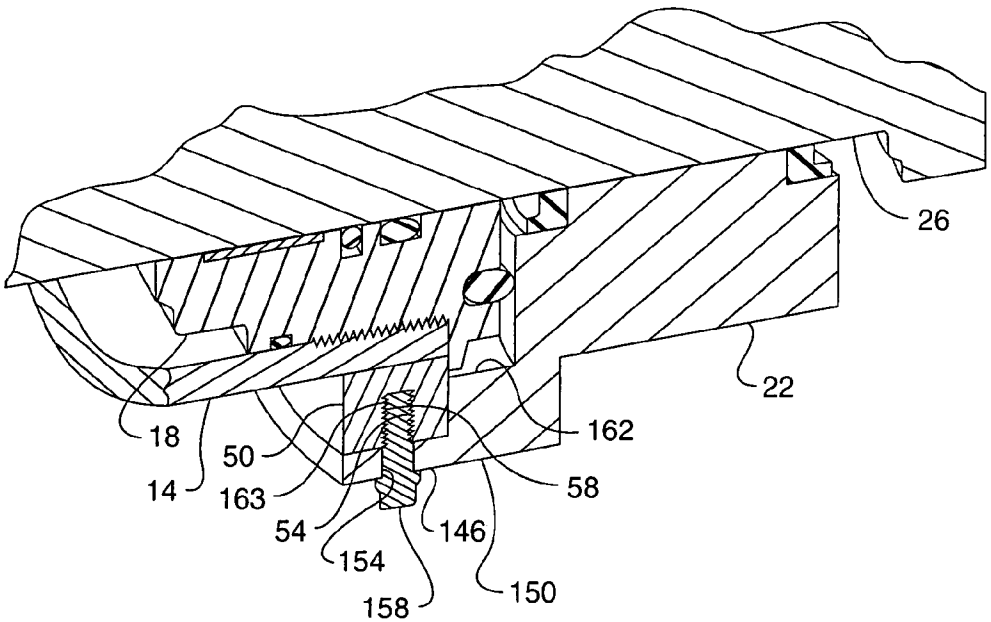
FIG. 3 is a fragmentary cutaway perspective view of an alternative embodiment according to the present invention.

A first mounting portion 50 may be provided on the outer wall 14*a* of the cylinder body 14. In the embodiment of FIG. 1A, the first mounting portion 50 is a flange member extending radially outward from the cylinder body 14 and may be welded to the cylinder body 14. The flange member 50 has a first opening 54 therein, the first opening 54 being arranged in a substantially longitudinal orientation. In an alternative embodiment (FIG. 3), the first opening 54 is arranged in a substantially radial orientation. For assembly purposes, the first opening 54 may have a threaded section 58 therein. It should be appreciated that one, two, three, four, or more first mounting portions 50 may be provided on the cylinder body 14. The embodiment shown in FIGS. 1A and 2 includes three first mounting portions 50, but alternative embodiments may include less or more (for example four) mounting portions 50, depending for example on strength or configuration requirements.

Referring again to FIG. 1A, a generally cylindrical gland member 18 may be disposed within the gland opening 38 of the cylinder body 14 and may be sealingly engaged with the inner wall 14*b* of the cylinder body 14. The gland member 18 has a rod opening therein, such as a longitudinal throughbore 62, configured for slidable receipt of the rod member 26. A radially outer surface 66 of the gland member 18 may provide threads 46*b* for engaging the threads 46*a* of the inner wall 14*b* of the cylinder body 14. A seal groove 70 may also be provided along the outer surface of the gland member 18, and a seal 74 may be provided therein for ensuring a sealing engagement between the gland member 18 and the inner wall 14*b* of the cylinder body 14. Grooves 78, 82, 86 may be provided along an internal wall 94 of the gland member 18 for seating a wear ring 98, a buffer seal 102, and a rod seal 106, respectively. In an alternative embodiment (FIG. 1B), a groove 90 having a wiper seal 110 therein may be provided. The gland member 18 may have a flange portion 114 disposed outside of the gland opening 38 of the cylinder body 14 and extending radially outward, for example beyond the inner and outer walls 14*b*, 14*a* of the cylinder body 14.

Figure 1B:
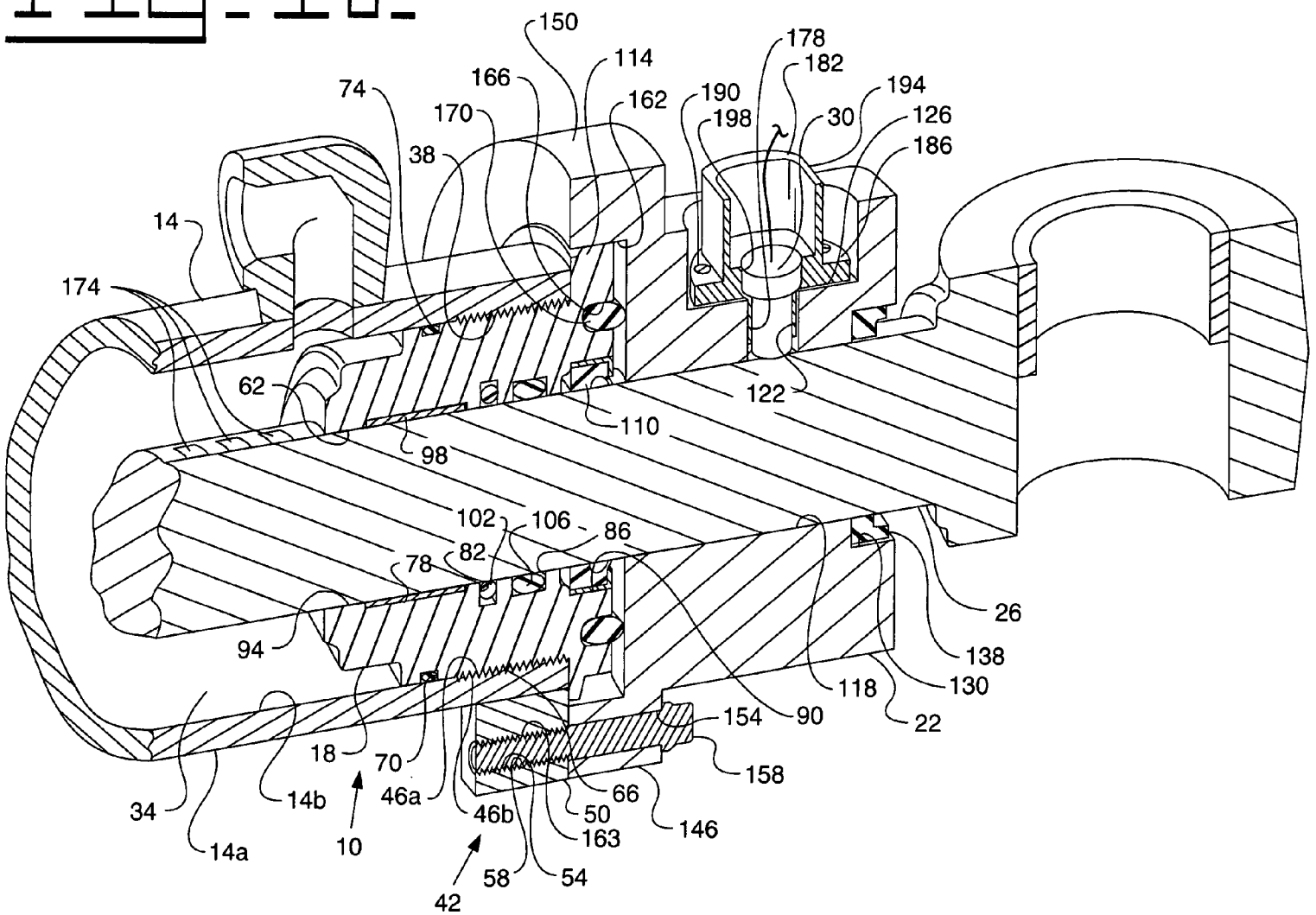
FIG. 1B is a fragmentary cutaway perspective view of an alternative embodiment according to the present invention.

The sensor mount 22 shown in FIG. 1A is disposed proximate the end 42 of the cylinder body 14 and adjacent the gland member 18. The sensor mount 22 has a rod opening therein, such as a longitudinal throughbore 118, for slidably receiving the rod member 26. It should be appreciated that the sensor mount 22 need not extend completely around the rod member 26. A sensor bore 122 may be arranged radially within the sensor mount 22 and may intersect the longitudinal throughbore 118. A sensor counterbore 126 generally in alignment with the sensor bore 122 may be formed in the sensor mount 22. Grooves 130, 134 may be provided within the sensor mount 22 for seating wiper seals 138, 142 outboard of the sensor bore 122 and sensor 30 and inboard of the sensor bore 122 and sensor 30, respectively. The wiper seals 138 and 142 (or 110, as in FIG. 1B) may be configured to engage the outer surface of the rod 26 to keep the area along the rod 26 between the wiper seals 138 and 142 (or 110) free from debris or other substances that may interfere with operation of the sensor 30. It should be appreciated that an alternative embodiment may exclude both of the seals 142 (FIG. 1A), 110 (FIG. 1B).

The sensor mount 22 provides a second mounting portion 146 thereon. In the embodiment of FIG. 1A, the second mounting portion 146 is formed within a flange portion 150 of the sensor mount 22 that extends radially outward from the mount 22 and around the circumference of the mount 22. The second mounting portion 146 may include a second opening 154 therein, the second opening 154 being arranged in a substantially longitudinal orientation.

In an alternative embodiment (FIG. 3), the flange portion 150 and the second mounting portion 146 of the sensor mount 22 may extend over the first mounting portion 50 so that the first mounting portion 50 is seated within the flange portion 150. In such an embodiment, the second opening 154 may be arranged in a substantially radial orientation.

Referring again to FIG. 1A, the second mounting portion 146 of the sensor mount 22 is aligned with the first mounting portion 50 of the cylinder body 14, and the second opening 154 is aligned with the first opening 54. The mounting portions 50, 146 may be attached together via a coupling engagement. For example, a mounting pin 158, such as a bolt, may be arranged within the second opening 154 and the first opening 54. Threads 163 on the mounting pin 158 may engage threads 58 in the first opening 54, and as the mounting pin 158 is rotated relative the first and second openings 54, 154, the second mounting portion 146 is urged toward and coupled to the first mounting portion 50, and the sensor mount 22 may be urged toward and coupled to the cylinder body 14. In an alternative embodiment (not shown), the mounting pin 158 may extend completely through the first opening 54 of the embodiment of FIG. 1 to engage a nut on the rear side of the first opening 54, and the mounting pin 158 and nut may be tightened together to urge and couple together the first and second mounting portions 50, 146 and the cylinder body 14 and the sensor mount 22.

The sensor mount 22 may have a counterbore 162 therein. The counterbore 162 may be sized to receive the gland member 18 and the end 42 of the cylinder body 14. For example, the flange portion 114 of the gland member 18 may be seated within the counterbore 162 of the sensor mount; a seal groove 166 may be provided within a mating, radially-arranged face of the gland member 18 (or within a radially-arranged face of the sensor mount 22); and a seal 170 may be seated within the groove 166 to provide a sealed engagement between the radially-arranged face of the gland member 18 and a radially-arranged face of the sensor mount 22. The sealed engagement between the gland member 18 and the sensor mount 22 may prevent or inhibit debris or other substances from entering the area between the wiper seals 138, 142 and affecting the performance of the sensor 30.

The rod member 26 is slidably arranged within the throughbores 118, 62 of the sensor mount 22 and the gland member 18 and extends into the longitudinal cylinder chamber 34 of the cylinder body 14, where the rod member 26 may be operably connected with a piston (not shown), as is known in the art, to form a piston-and-rod assembly. One or more detectable features 174, such as barcode markings, may be disposed in a predetermined orientation along the length of the rod 26. It should be appreciated that the features 174 are shown in FIG. 1A, for explanatory purposes, as being inboard of the gland member 18, and that the features 174 may extend along the full length of the rod 26 in practice.

A position sensor 30 is connected to the sensor mount 22 and is arranged in alignment with the path of the detectable features 174 of the rod 26. The sensor 30 may be operable to detect the one or more detectable features 174 and responsively generate a signal indicative of the position of the rod 26 as a function of the one or more detectable features 174.

In the embodiment of FIG. 1A, the sensor 30 is housed within a radially arranged bore 178 of a sensor subhousing 182, for example via a press-fit or set screw configuration. The subhousing 182 includes a flange 186, which is seated within the counterbore 126 of the sensor mount 22, and the subhousing 182 is attached to the sensor mount 22 via one or more screws 190 or the like. The subhousing 182 includes a connector wall 194 that may protect the sensor 30 while providing a connecting surface for attaching a connector (not shown) to the sensor 30. For example, a mating connector having an outer diameter slightly larger (or slightly smaller) than that of the connector wall 194 may be coupled with the connector wall 194 while engaging electrical contacts (not shown) on the sensor 30. The subhousing may further include a counterbore 198 wherein the sensor 30 may be seated during assembly. A groove 204 may be provided in the sensor bore 122 for seating a seal 208, such as an O-ring. The seal 208 may ensure a sealed engagement between the outer circumference of the sensor 30 and the sensor bore 122 to prevent or inhibit debris from entering the area between the sensor 30 and the rod member 26.

INDUSTRIAL APPLICABILITY

The present invention provides an affordable and robust sensor mount operable to accurately mount a position sensor to a hydraulic cylinder.

The cylinder assembly 10 of FIG. 1A may be assembled by placing the rod member 26 through the throughbores 118, 62 of the sensor mount 22 and the gland member 18, inserting the rod member 26 into the longitudinal cylinder chamber 34 of the cylinder body 14, and attaching the rod member 26 to a piston (not shown). The gland member 18 may be threaded into the gland opening 38 and cylinder chamber 34 of the cylinder body 14 (via rotation of the gland member 18 relative the cylinder body 14), thereby sealing the longitudinal cylinder chamber 34 of the cylinder body 14. The sensor mount 22 may be attached to the end 42 of the cylinder body 14 and adjacent the gland member 18 via the mounting pin 158 and the first and second mounting portions 50, 146, as described above, to form a coupling engagement between the first and second mounting portions 50, 146.

It should be appreciated that when the sensor mount 22 of FIG. 1A is secured to the cylinder body 14, and the counterbore 162 of the sensor mount 22 is urged tightly against the gland member 18 (for example via the mounting pin 158), the gland member 18 may be prevented or at least inhibited by the sensor mount 22 from rotating out of, or otherwise becoming unseated from, the gland opening 38 of the cylinder body 14. Thus, the sensor mount 22 may provide a locking function by holding the gland member 18 in sealing engagement with the cylinder body 14. As a result of this locking function, the cylinder assembly 10 may be enabled to withstand higher operating pressures within the cylinder body 14.

In one exemplary embodiment of the present invention (FIG. 1A), the path of the detectable features 174 is arranged in a substantially predetermined orientation on the rod member 26; the rod member 26 is arranged in a substantially predetermined rotational orientation relative the cylinder body 14 and the first mounting portion 54 (for example, if the cylinder body 14 and the rod member 26 are each fixedly attached to components of a work machine); the sensor 30 is arranged in a predetermined orientation relative the sensor mount 22 and the second mounting portion 154, for example via the sensor bore 122 and the sensor subhousing 182; and the first and second mounting portions 50, 146 are coupled together in a substantially predetermined orientation relative to each other, for example via alignment of the first and second openings 54, 154 and insertion of the mounting pin 158 therethrough. As a result, the position sensor 30 will be substantially aligned with a path of the detectable features 174, and the position sensor 30 will function properly without regard to the rotational configuration of the gland member 18 relative the cylinder body 14 or the rod member 26. Thus, during assembly the gland member 18 may be tightened relative the cylinder body 14 (via threads 46*a*, 46*b* for example) to a desired degree without regard to the gland member's final orientation relative the detectable features 174 of the rod 26.

It should further be appreciated that the disclosed sensor mount 22 may be added to an existing cylinder assembly without substantial modification of the cylinder assembly's components. For example, the sensor mount 22 may be added to the assembly without tapping holes in the existing gland member or head of the assembly. As disclosed herein, one or more first mounting portions 50 may be welded or otherwise affixed to a cylinder body 14 to facilitate attachment of the sensor mount 22 to the cylinder body 14.

From the foregoing it will be appreciated that, although specific embodiments of the invention have been described herein for purposes of illustration, various modifications may be made without deviating from the spirit or scope of the invention. Other embodiments of the invention will be apparent to those skilled in the art from consideration of the specification and figures and practice of the invention disclosed herein. It is intended that the specification and disclosed examples be considered as exemplary only, with a true scope and spirit of the invention being indicated by the following claims and their equivalents. Accordingly, the invention is not limited except as by the appended claims.

What is claimed is:

1. A cylinder assembly comprising:

a cylinder body having a longitudinal cylinder chamber therein, a gland opening at an end of the cylinder body, and a first mounting portion disposed on the cylinder body;

a gland member having a rod opening therein, the gland member being disposed within the gland opening of the cylinder body;

a sensor mount having a rod opening therein, the sensor mount being disposed proximate the end of the cylinder body and adjacent the gland member and having a second mounting portion disposed on the sensor mount;

a rod member slidably arranged within the rod openings of the sensor mount and the gland member and extending into the longitudinal cylinder chamber of the cylinder body; and a position sensor attached to the sensor mount;

wherein the sensor mount is attached to the cylinder body, wherein the second mounting portion of the sensor mount engages the first mounting portion of the cylinder body, and wherein the first and second mounting portions are coupled together in a substantially predetermined orientation with respect to each other.

2. The cylinder assembly of claim 1, wherein:

the first mounting portion has a first opening therein;

the second mounting portion has a second opening therein; and the cylinder assembly includes a mounting pin arranged within the first and second openings, at least a portion of the mounting pin being disposed radially outside of the gland member.

3. The cylinder assembly of claim 2, wherein the sensor mount and the cylinder body are coupled together and urged toward each other via the mounting pin.

4. The cylinder assembly of claim 2, wherein the first and second openings are arranged in a substantially longitudinal orientation.

5. The cylinder assembly of claim 2, wherein the first and second openings are arranged in a substantially radial orientation relative the longitudinal cylinder chamber of the cylinder body.

6. The cylinder assembly of claim 2, wherein:

the first mounting portion provides a threaded section inside the first opening; and the mounting pin is threadedly engaged with the threaded section.

7. The cylinder assembly of claim 1, wherein:

the cylinder body includes a radially internal wall; the gland member includes a radially outer surface;

the radially outer surface of the gland member is engaged with the radially internal wall of the cylinder body; and the sensor mount is urged against the gland member via a coupling engagement between the second mounting portion of the sensor mount and the first mounting portion of the cylinder body.

8. The cylinder assembly of claim 7, wherein:

the radially internal wall of the cylinder body has a first threaded area thereon;

the radially outer surface of the gland member has a second threaded area thereon;

the gland member is engaged with the cylinder body via the first and second threaded areas; and the sensor mount is configured and arranged to prevent or inhibit the gland member from rotating in at least one direction relative the cylinder body.

9. The cylinder assembly of claim 1, wherein:

one end of the sensor mount has a counterbore therein; and the gland member is seated within the counterbore of the sensor mount.

10. The cylinder assembly of claim 9, wherein the gland member is sealingly seated within the counterbore of the sensor mount.

11. The cylinder assembly of claim 1, wherein the position sensor is attached to the sensor mount in a substantially predetermined orientation relative the second mounting portion.

12. The cylinder assembly of claim 11, wherein:

the rod includes one or more detectable features disposed longitudinally along the length of the rod; and the rod is arranged with respect to the cylinder body so that a path of the one or more detectable features is disposed in a substantially predetermined orientation relative the first mounting portion.

13. The cylinder assembly of claim 11, wherein:

the sensor mount includes a sensor bore intersecting the rod opening of the sensor mount; and the position sensor is disposed within the sensor bore.

14. The cylinder assembly of claim 1, wherein the sensor mount includes a first wiper element disposed outboard of the position sensor and in engagement with a surface of the rod, and a second wiper element disposed inboard of the position sensor and in engagement with a surface of the rod.

15. The cylinder assembly of claim 1, wherein:

the rod includes one or more detectable features thereon; and the position sensor is mounted in a predetermined orientation with respect to a path of the one or more detectable features and is operable to detect the one or more detectable features and produce a signal indicative of the position of the rod as a function of the one or more detectable features.

16. The cylinder assembly of claim 1, including a seal member pressed between a radially arranged face of the sensor mount and a radially arranged face of the gland member.

17. The cylinder assembly of claim 1, wherein the first mounting portion is a flange extending radially outward from the cylinder body.

18. A cylinder assembly comprising:

a cylinder body having a longitudinal cylinder chamber therein, a gland opening at an end of the cylinder body, and a first mounting portion disposed on the cylinder body;

a gland member having a rod opening therein, the gland member being disposed within the gland opening of the cylinder body;

a sensor mount having a rod opening therein, the sensor mount being disposed proximate the end of the cylinder body and adjacent the gland member and having a second mounting portion disposed thereon, at least a portion of the second mounting portion disposed radially outside of the gland member;

a rod member slidably arranged within the rod openings of the sensor mount and the gland member and extending into the longitudinal cylinder chamber of the cylinder body, the rod having one or more detectable features disposed longitudinally along the length of the rod member; and a position sensor attached to the sensor mount, the position sensor being operable to detect the detectable features;

wherein the second mounting portion of the sensor mount is urged toward the first mounting portion of the cylinder body to hold the sensor in a substantially predetermined orientation relative the path of the one or more detectable features.

19. The cylinder assembly of claim 18, wherein:

the first mounting portion has a first opening therein;

the second mounting portion has a second opening therein disposed in the portion of the second mounting portion disposed radially outside of the gland member; and the cylinder assembly includes a mounting pin arranged within the first and second openings.

20. The cylinder assembly of claim 19, wherein the first and second mounting portions are urged toward each other via the mounting pin.

21. The cylinder assembly of claim 18, wherein:

the gland member includes a flange portion disposed external to the gland opening of the cylinder body; and the flange portion of the gland member is disposed between the sensor mount and the end of the cylinder body.

22. A method for determining the position of a rod slidably arranged within a longitudinal cylinder chamber of a cylinder body having a gland member disposed within one end of the cylinder body, the gland member having a rod opening therein for slidably receiving the rod, the method comprising:

providing a first mounting portion on the cylinder body;

providing a sensor mount having a rod opening therein, a second mounting portion thereon, and a position sensor attached thereto;

providing one or more detectable features along the length of the rod;

aligning the position sensor with a path of the one or more detectable features;

mounting the sensor mount to the end of the cylinder body and adjacent the gland member by fastening together the second mounting portion of the sensor mount and the first mounting portion of the cylinder body, at least a portion of the first mounting portion being disposed adjacent at least a portion of the second mounting portion;

moving the rod within the rod openings of the gland member and the sensor mount; and operating the sensor to detect the detectable features of the rod and to generate a signal as a function of the detectable features, the signal being indicative of the position of the rod.

23. The method of claim 22, including attaching the first mounting portion to an outer surface of the cylinder body.

24. The method of claim 22, including:

aligning a first opening in the first mounting portion of the cylinder body with a second opening in the second mounting portion of the sensor mount; and inserting a mounting pin through the first and second openings.

25. The method of claim 24, including urging the sensor mount toward the cylinder body by rotating the mounting pin relative the first and second openings.

26. The method of claim 25, including urging the sensor mount against the gland member by rotating the mounting pin relative the first and second openings.

27. The method of claim 26, including urging the sensor mount against the gland member to hold the gland member in position with respect to the cylinder body.

28. The method of claim 22, wherein each of the detectable features encircles less than a circumference of the rod.

29. The method of claim 22, wherein the detectable features are substantially linearly aligned along the length of the rod.

* * * * *